United States Patent [19]

Munekawa

[11] Patent Number: 4,724,901

[45] **Date of Patent: * Feb. 16, 1988**

[54] DEVICE FOR RELEASING HEAT

[75] Inventor: Masaaki Munekawa, Sakai, Japan

[73] Assignee: Showa Aluminum Kabushiki Kaisha, Osaka, Japan

[ * ] Notice: The portion of the term of this patent subsequent to Dec. 16, 1999 has been disclaimed.

[21] Appl. No.: 151,571

[22] Filed: May 20, 1980

[51] Int. Cl.[4] ..... F28D 15/00

[52] U.S. Cl. ..... 165/104.21; 29/157.3 V; 29/157.3 B; 165/104.33; 357/82; 361/385

[58] Field of Search ..... 165/104.21, 104.33, 165/182; 357/82; 361/385; 29/157.3 V, 157.3 HP, 157.3 B

[56] References Cited

U.S. PATENT DOCUMENTS 4,083,093 4/1978 Chertok ..... 29/157.3 V
4,120,019 10/1978 Arii et al. ..... 357/82 X
4,222,436 9/1980 Pravda .

FOREIGN PATENT DOCUMENTS 2543075 7/1976 Fed. Rep. of Germany ..... 361/385

*Primary Examiner*—Albert W. Davis, Jr.
*Attorney, Agent, or Firm*—Armstrong, Nikaido, Marmelstein & Kubovcik

[57] ABSTRACT

A heat releasing device comprising a heat transmitting block having a heat source attaching portion and a bore extending therethrough, a looped heat pipe having at least one pair of straight tubular portions, the first of the straight tubular portions being intimately fitted in the bore, and a multiplicity of radiating fins attached to the heat pipe.

5 Claims, 11 Drawing Figures

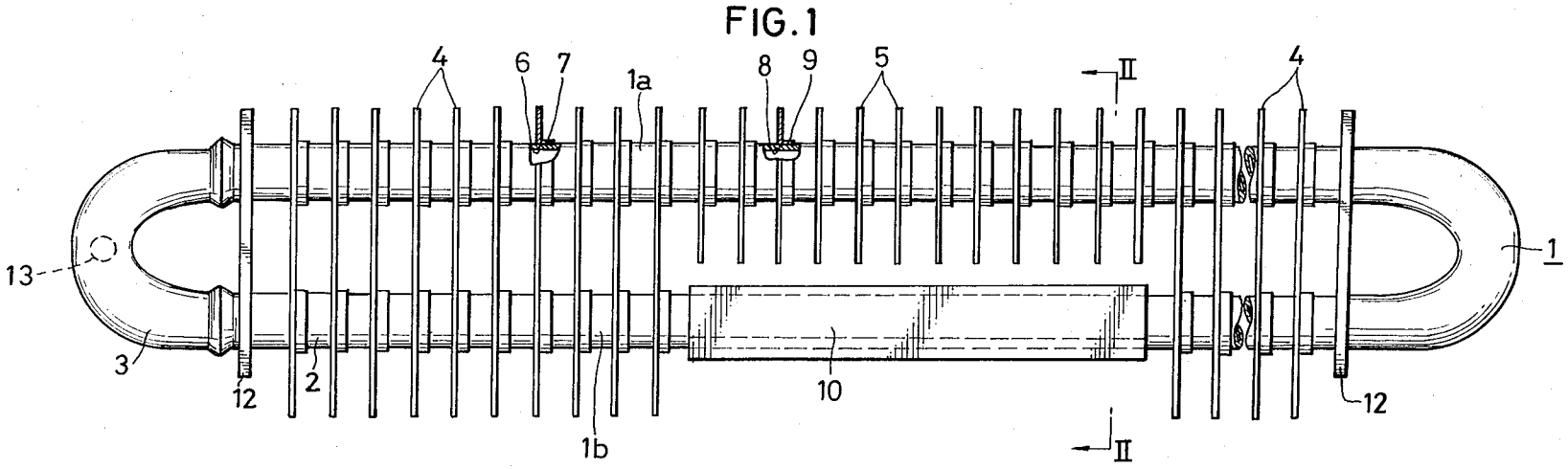
FIG. 1
FIG. 2
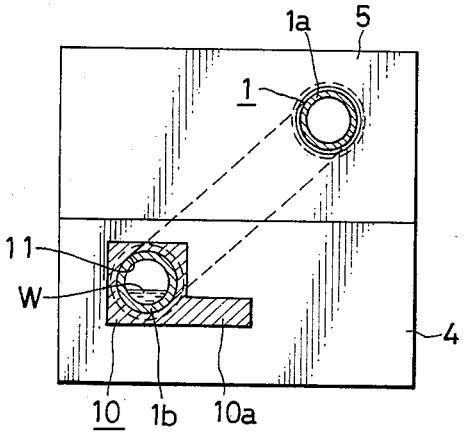
FIG. 3
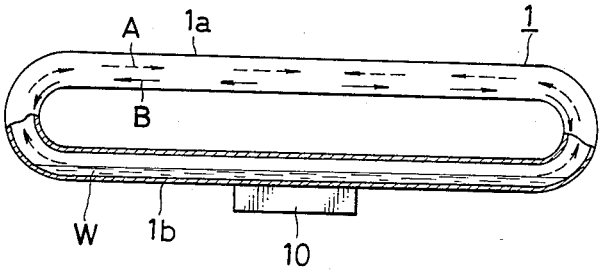

DEVICE FOR RELEASING HEAT

BACKGROUND OF THE INVENTION

The present invention relates to a device for releasing heat, and more particularly to a heat sink to be attached to an apparatus incorporating transistors, IC circuits, etc. for effectively dissipating the heat emitted therefrom.

Heat releasing devices of this type are chiefly made of extruded shaped materials. While they are easy to manufacture, the extrusion technique involves the requirement that the main body of the device as well as the fin portions thereof should have a substantial wall thickness. Other heat releasing devices are also known which comprise a straight heat pipe. These devices are smaller but have a higher radiation efficiency than those made of extruded material. However since a heat source attaching block is fixed to a portion of the pipe, the device has a somewhat reduced radiation efficiency at this portion.

SUMMARY OF THE INVENTION

The present invention has been accomplished in view of the above problems. An object of the invention is to provide a heat releasing device which has the advantage of those comprising a straight heat pipe but is free of the drawback thereof and which has an exceedingly high heat releasing efficiency.

Another object of the invention is to provide a compacted heat releasing device.

Still another object of the invention is to provide a heat releasing device which is usable in a position inclined at the desired angle.

These objects can be fulfilled by a heat releasing device comprising a heat transmitting block having a heat source attaching portion and a bore extending therethrough, a looped heat pipe having at least one pair of straight tubular portions, the first of the straight tubular portions being intimately fitted in the bore, and a multiplicity of radiating fins attached to the heat pipe.

The looped heat pipe is not limited in its overall shape insofar as the pipe has at least one pair of straight tubular portions. For example, the heat pipe is in the form of an elongated loop comprising a hairpin tube and a U-shaped tube which are joined together at their opposed abutting ends, or in the form of a bent loop L-shaped in its entirety and comprising a pair of hairpin tubes and a pair of bent tubes interconnecting the hairpin tubes.

The heat pipe may be of the wick type or of the gravity type. Useful working fluids are those generally used, such as water, ammonia, methanol and the like.

The radiating fins are usually square or rectangular but are not limited to such a shape.

This invention will be described below in greater detail with reference to the illustrated embodiments.

With these embodiments, the reference to the position or orientation thereof is based on FIGS. 2, 7 and 9. The upper side of these drawings is designated as the upper side of the device, and the left side of the drawings as the front side of the device.

BRIEF DESCRIPTION OF THE DRAWINGS

FIG. 1 is a front view showing a heat releasing device according to a first embodiment;

FIG. 2 is a view in section taken along the line II—II in FIG. 1;

FIG. 3 is a view partly in vertical section and showing the device in operation;

DESCRIPTION OF THE PREFERRED EMBODIMENTS

Figure 4A:
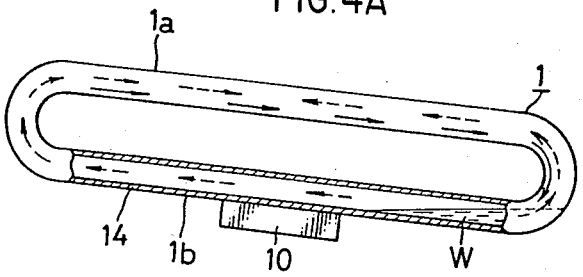
FIG. 4(A) is a front view showing a device of the wick type as used in an inclined position.

FIGS. 1 to 5 show a first embodiment of the invention.

With reference to FIGS. 1 and 2, a heat pipe 1 serving as the main body of a heat releasing device of the invention comprises a hairpin tube 2 and a U-shaped tube 3 which are joined together by butt welding in the form of a greatly elongated loop. Indicated at 4 are square fins attached to the heat pipe 1, and at 5 are rectangular fins attached to the middle portion of the length of the heat pipe 1 and in the form of one half of the square fin 4. The square fin 4, as well as the rectangular fins 5, are arranged at specified spacing.

The square fin 4 has a pair of holes 6 for passing a pair of straight tubular portions 1*a* and 1*b* of the heat pipe 1, and a collar 7 around each of the holes 6. The rectangular fin 5 has a hole 8 through which the upper tubular portion 1*a* of the heat pipe extends, and a collar 9 around the hole 8. The diameter of the holes 6 and 8 coincides with the outside diameter of the heat pipe 1. The center-to-center distance between the pair of holes 6 is of course equal to the center-to-center distance between the pair of straight tubular portions 1*a* and 1*b* of the heat pipe 1. A heat transmitting block 10 of square cross section is mounted on the middle of the length of the lower straight tubular portion 1*b* of the pipe 1 and has a heat source attaching portion 10*a* projecting rearward from a lower part of the block. The lower straight tubular portion 1*b* is intimately fitted in a bore 11 extending through the block 10 longitudinally thereof. A pair of side plates 12 are provided at opposite ends of the heat pipe 1, with the group of fins disposed therebetween. An inlet 13 for a working fluid is formed in a bent portion of the pipe 1. The fins 4 and 5, the heat transmitting block 10 and the pair of side plates 12 are of course attached to the heat pipe 1 before the U-shaped tube 3 is joined to the hairpin tube 2. Preferably the hairpin tube 2 is diametrically enlarged before being joined to the tube 3 and is thereby held in intimate contact with the collars 7, 9 of the fins 4, 5, the block 10 and the side plates 12. The working fluid is of course enclosed in the pipe after the joining.

The heat releasing device of this embodiment is usually so disposed that the pair of straight tubular portions 1*a* and 1*b* are horizontal as seen in FIG. 1, with the bent opposite ends in an inclined position when seen from one side as shown in FIG. 2.

FIG. 3 shows the heat pipe in operation. The working fluid W in the heating portion, namely, in the lower tubular portion 1b is vaporized with the heat delivered thereto from a heat source, such as transistors, through the heat transmitting block 10 and flows through the bent ends to the heat releasing portion, namely, to the upper tubular portion 1a as indicated by broken-line arrows A in FIG. 3. In this portion the vapor of fluid W releases heat, returns to a liquid and flows back to the heating portion along the inner surface of the pipe as indicated in solid-line arrows B in the drawing. In this way the heat pipe operates for the dissipation of heat.

Figure 4B:
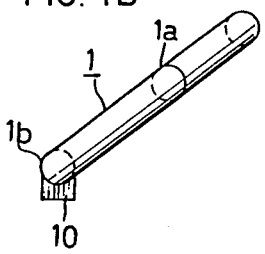
FIG. 4(B) is a side elevation corresponding to FIG. 4(A)
Figure 5A:
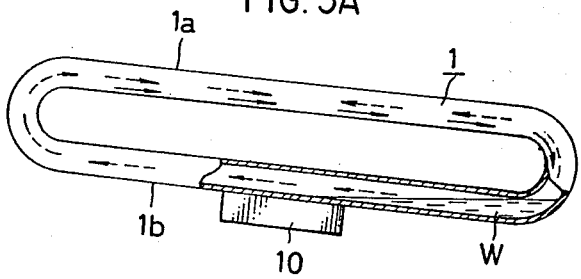
FIG. 5(A) is a front view showing a device of the gravity type as used in an inclined position.
Figure 5B:
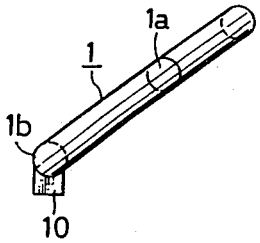
FIG. 5(B) is a side elevation corresponding to FIG. 5(A)

The heat releasing device of this invention is usable in an inclined position as it is seen sideways and also as it is seen from the front, as shown in FIGS. 4 and 5. FIGS. 4(A) and (B) show a device of the wick type having a wick 14 housed only in the lower straight tubular portion 1b serving as the heating portion. The upper straight tubular portion 1a, namely, the heat releasing portion operates as a heat pipe of the gravity type involving reduced thermal resistance. The wick-type heat pipe of FIG. 4 is serviceable for the desired heat transfer also in a horizontal position as it is seen from the front. FIGS. 5(A) and (B) show a heat pipe of the gravity type. In this case, a somewhat larger amount of working fluid W is enclosed in the pipe, or the heat transmitting block 10 is positioned closer to the downwardly inclined lower end of the pipe so that the portion of the pipe bearing on the block 10 will be in contact with the working fluid W at all times even if the tubular portions 1a, 1b are inclined.

Figure 6:
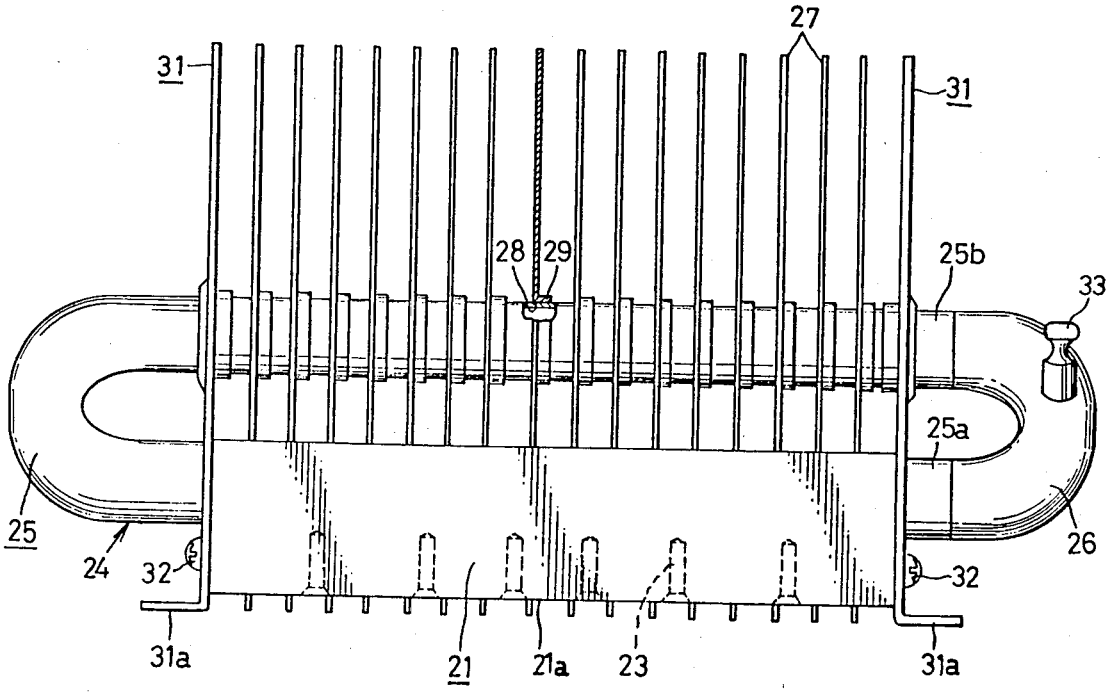
FIG. 6 is a front view showing a heat releasing device according to a second embodiment.
Figure 7:
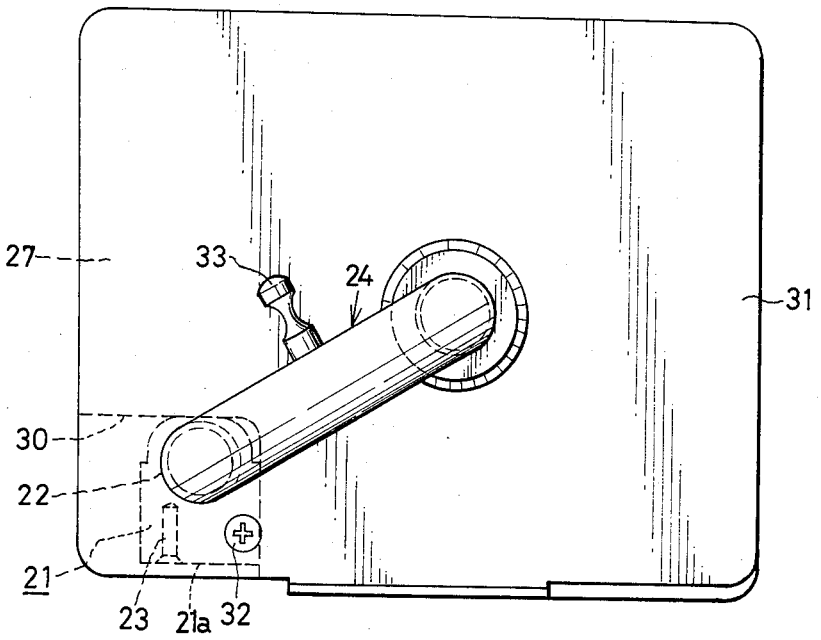
FIG. 7 is a side elevation corresponding to FIG. 6.

With reference to FIGS. 6 and 7 showing a second embodiment of the invention, a substantially rectangular parallelepipedal, heat transmitting block 21 has a bore 22 longitudinally extending through an upper portion of the block and is formed, in its bottom, with a number of screw bores 23 for attaching a heat source to the block. Thus the bottom portion serves as a heat source attaching portion 21a. A heat pipe 24 is in the form of a elongated loop and comprises a hairpin tube 25 and a U-shaped tube 26 which are joined together at their opposed abutting ends. Before they are joined together, one straight tubular portion 25a of the hairpin tube 25 is passed through the bore 22 of the block 21 and thereafter diametrically enlarged into intimate contact with the inner surface defining the bore 22. A multiplicity of substantially rectangular radiating fins 27 each have a hole 28 of specified diameter approximately in the center and a collar 29 around the hole 28. Each of the fins 27 has a rectangular cutout 30 at its front lower corner. The fins 27 are attached to the other straight tubular portion 25b of the hairpin tube 25 as equidistantly spaced apart thereon in the following manner. The fins 27 are fitted at the holes 28 around the tubular portion 25b as arranged at specified spacing thereon and brought into contact with the rear surface and the top surface of the block 21 at the cutout portions 30. The tubular portions 25b is thereafter diametrically enlarged and thereby held in intimate contact with the collars 29 of the fins 27. A pair of side plates 31 provided on opposite sides of the group of fins 27 are mounted on opposite ends of the heat pipe 24 for the installation of the device and are secured to the ends of the block 21 with screws 32. The pair of side plates 31 each have a bent lower end portion 31a extending outward toward the extremity of the heat pipe 24, whereby the device is attached to the frame of an audio apparatus or the like with screws. Indicated at 33 is an inlet formed in the U-shaped tube 26 for the working fluid. After the hairpin tube 25 has been joined to the U-shaped tube 26, the fluid is introduced into the heat pipe through the inlet 33, which is thereafter sealed.

With the present embodiment, the radiating fins 27 are held in contact with the block 21 at the cutout portions 30, at which the heat delivered to the block 21 is partly transferred directly to the fins 27 for the release of heat. The cutout portions 30 also prevent the fins from turning about the upper tubular portion 25b.

Figure 9:
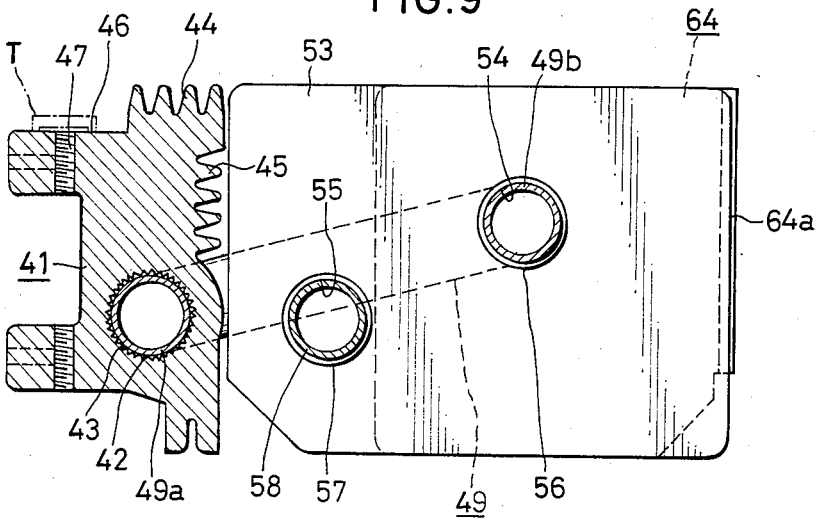
FIG. 9 is a view in section taken along the line IX—IX in FIG. 8.
Figure 8:
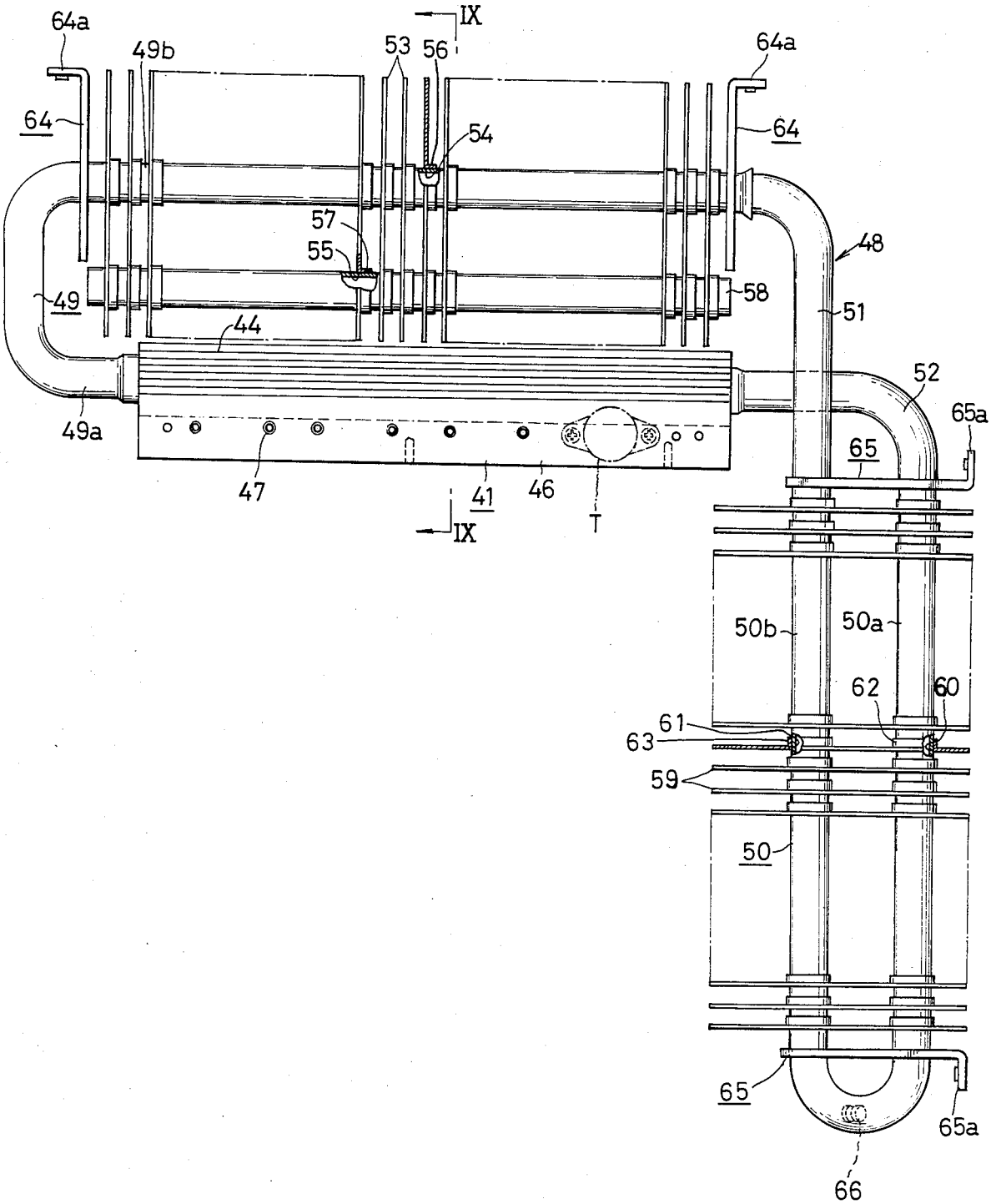
FIG. 8 is a plan view showing a heat releasing device according to a third embodiment.

FIGS. 8 and 9 show a third embodiment of the invention. With reference to these drawings, a heat transmitting block 41 is in the form of a channel member positioned with its one side down as seen in FIG. 9. The block 41 has a bore 42 longitudinally extending through a lower portion thereof and defined by a jagged inner peripheral surface 43 having ridges of triangular cross section. An upper side rear portion and the rear side of the block 41 have jagged surfaces 45 and 45, respectively, of serrated cross section for dissipating the heat delivered to the block 41, for example, from transistors or the like. The block 41 has at an upper side front portion thereof a heat source attaching portion, to which transistors T, serving as a heat source, are attached with screws driven into bores 47. A looped heat pipe 48 is bent approximately to an L-shape when seen in plan and comprises first and second hairpin tubes 49 and 50 in a pair and a pair of bent tubes 51 and 52 interconnecting the hairpin tubes at their opposed abutting ends. Before the tubes are joined together, one straight tubular portion (hereinafter referred to as "first straight tubular portion") 49a of the first hairpin tube 49 is inserted through the bore 42 of the block 41 and thereafter diametrically enlarged into intimate contact with the jagged surface 43 defining the bore 42. A multiplicity of first radiating fins 53 for the first hairpin tube 49 are each in the form of an approximately rectangular plate. Each of the fins 53 has a center hole 54 and a marginal hole 55 of specified diameter and collars 56 and 57 around the holes 54 and 55 respectively. With the other straight tubular portion (hereinafter referred to as "second straight tubular portion") 49b of the first hairpin tube 49 fitted in the center holes 54, the first fins 53 are arranged on the second straight tubular portion 49b at specified spacing first, and the second tubular portion 49b is thereafter diametrically enlarged into intimate contact with the collars 56, whereby the first fins 53 are attached to the second tubular portion 49b. A turn preventing member 58 extends through the marginal holes 55 of the first fins 53. Although a straight tube having the same diameter as the heat pipe 48 is used as the member 58 in the present embodiment, the member 58 may of course be in the form of a rod. A multiplicity of radiating fins 59 are mounted on the second hairpin tube 50 of the heat pipe 48. First, the fins 59 are arranged on the second hairpin tube 50 at specified spacing, with a pair of straight tubular portions 50a and 50b of the tube 50 extending through holes 60 and 61 respectively, and the tube 50 is thereafter diameterically enlarged into intimate contact with the fins 59. Pairs of side plates 64 and 65 for the installation of the device are mounted on the first and second hairpin tubes 49 and 50, with the first and second groups of fins 53 and 59 provided therebetween. The side plates have bent end portions 64a and 65a for attaching the device to the frame of an audio apparatus or the like with screws. An inlet 66 for the working fluid is formed in a bent portion of the second hairpin tube 50. After the first and second hairpin tubes 49 and 50 have been connected together by the pair of intervening bent tubes 51 and 52, the working fluid is introduced into the pipe 48 through the inlet 66, which is thereafter closed.

With this embodiment, the fins 53 are effectively prevented from turning about the second straight tubular portion **49*b* by the turn preventing member 58 extending through the group of fins 53. The jagged surface 43 defining the bore 42 serves to release heat directly from the block 41**.

What is claimed is:

1. A device for releasing heat comprising a heat transmitting block having a heat source attaching portion and a bore extending therethrough, the bore being defined by a jagged surface for releasing heat, a looped heat pipe having at least one pair of parallel straight tubular portions and at least one pair of bent portions, the first of the straight tubular portions being intimately fitted in the bore, and a multiplicity of radiating fins attached to the heat pipe the pipe having an inner portion in which a working fluid is sealingly enclosed, one of the straight tubular portion being positioned higher than the first straight tubular portion while bent portions connecting the straight tubular portions are inclined when seen in side view, the uppermost straight tubular portion serving as a condenser and the lower one as an evaporator.

2. A device as defined in claim 1 wherein the heat pipe comprises a hairpin tube and a U-shaped tube joined together by butt welding in the form of an elongated loop.

3. A device as defined in claim 1 wherein the first straight tubular portion is fitted in the bore of the heat transmitting block by being inserted into the bore and thereafter diametrically enlarged.

4. A device as defined in claim 1 wherein the radiating fins are attached only to the second of the straight tubular portions of the heat pipe, and a turn preventing member extends through the fins.

5. A device as defined in any one of claims 1 to 4 wherein the heat transmitting block has a heat releasing jagged surface on each of its upper side and rear side.

* * * * *